US005926900A

United States Patent [19]

Bennett

[11] Patent Number: 5,926,900

[45] Date of Patent: Jul. 27, 1999

[54] UNITARILY MOLDED TOOTHBRUSH

[75] Inventor: Robert Alfread Bennett, Easton, Conn.

[73] Assignee: Chesebrough-Pond's USA Co., Greenwich, Conn.

[21] Appl. No.: 09/018,987

[22] Filed: Feb. 5, 1998

Related U.S. Application Data

[60] Provisional application No. 60/049,721, Jun. 16, 1997.

[51] Int. Cl.[6] ..... A46B 1/00

[52] U.S. Cl. ..... 15/167.1; 15/187; 15/207.2

[58] Field of Search ..... 15/167.1, 186–188, 15/207.2

[56] References Cited

U.S. PATENT DOCUMENTS

| | | | |
|---|---|---|---|
| 1,817,585 | 8/1931 | Samuel | 15/188 |
| 2,065,584 | 12/1936 | Hempel | 15/188 |
| 3,125,776 | 3/1964 | Lilley | 15/207.2 |
| 3,214,777 | 11/1965 | Kutik | 15/187 |
| 3,302,230 | 2/1967 | Poppelmann | 15/167.1 |
| 4,408,920 | 10/1983 | Walther et al. | 401/176 |
| 4,503,871 | 3/1985 | Mendenhall | 132/311 |

FOREIGN PATENT DOCUMENTS

| | | |
|---|---|---|
| 4700338 | 3/1987 | Brazil . |
| 6700603 | 3/1987 | Brazil . |
| 27 28 672 | 6/1977 | Germany . |
| 42 23 697 | 1/1993 | Germany . |
| 351159 | 6/1931 | United Kingdom . |
| 92/00025 | 1/1992 | WIPO . |

OTHER PUBLICATIONS

Chevron Polyethylene Data Sheet–1997.

*Primary Examiner*—Mark Spisich
*Attorney, Agent, or Firm*—Milton L. Honig

[57] ABSTRACT

A unitarily molded toothbrush is provided including a head with bristles integrally molded therewith, the bristles being integrally anchored to a top surface of the head and having a polygonal cross-section defined by at least three faces, at least one of the faces gradually transitioning outward as a slope in an area near the head top surface to minimize breakage and deformation. Preferably the bristles have a triangular cross-section with slopes of two of the faces being different from one another.

8 Claims, 2 Drawing Sheets

FIG. 1
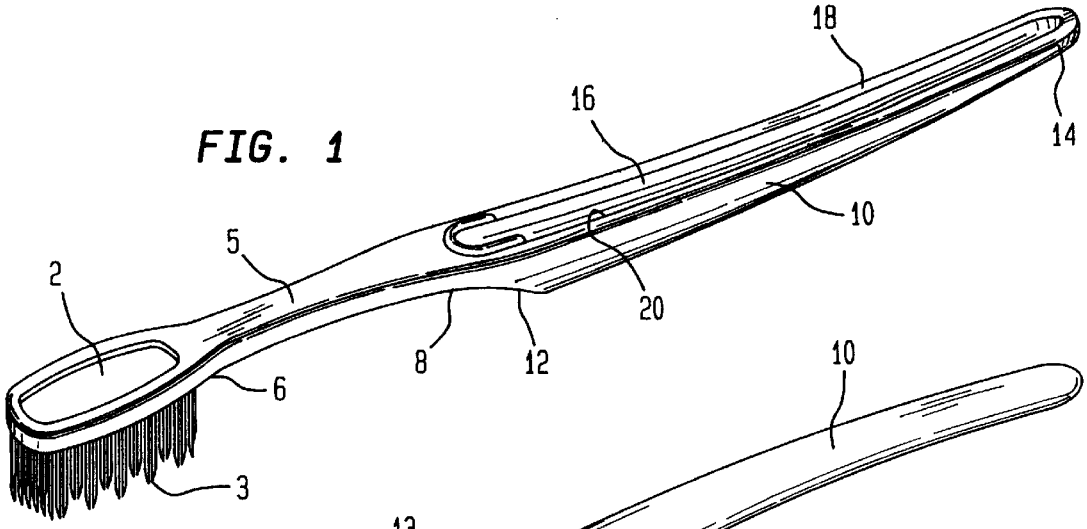
FIG. 2
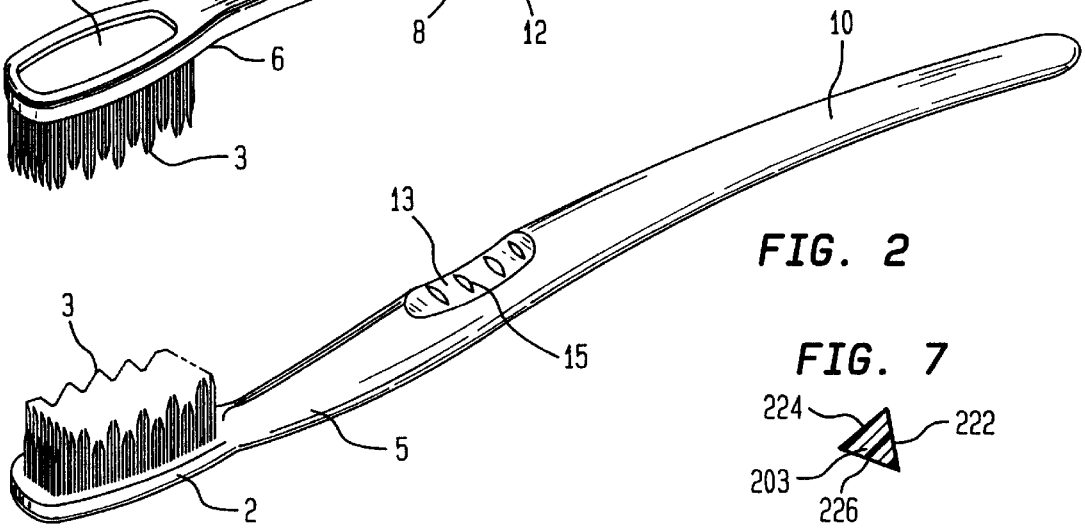
FIG. 7
FIG. 3 FIG. 4 FIG. 5 FIG. 6
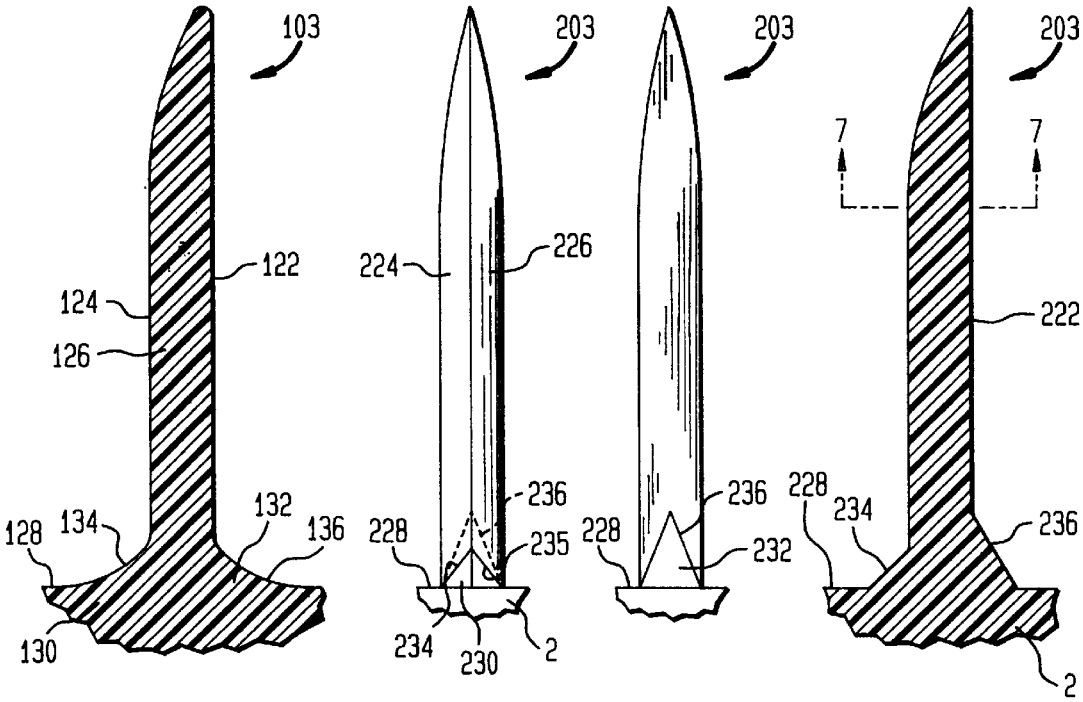

UNITARILY MOLDED TOOTHBRUSH

This application claims priority from a Provisional application Ser. No. 60/049,721 filed Jun. 16, 1997.

BACKGROUND OF THE INVENTION

1. Field of the Invention

The invention concerns a unitarily molded toothbrush manufacturable at low cost providing benefits both over known unitarily molded and non-unitarily manufactured traditional toothbrushes.

2. The Related Art

Millions of individuals around the world are too poor to afford a toothbrush. Even within industrialized countries, there exists a significant population for which this purchase is financially difficult.

No frills relatively low cost products are sold which resemble the expensive ones but without great detail in bristle configuration, handle aesthetics and mouthfeel of bristle tufts within the oral cavity. The bristles are neither sculpted into a shape complementary to the teeth nor the handle given any ergonomic feature. Yet virtually all commercial brushes whether low or high priced are produced by separately adding bristles to a head area anterior to the handle. Invariably the bristles are of a different material (e.g. nylon) than the material forming the head or handle. Two-piece construction greatly increases manufacturing costs. Special machinery is necessary to implant bristles into the head area. Unit production is thereby also relatively slow.

In a review of the art, it was found that certain airlines provide their first class passengers with pocket sized disposable toothbrushes. VARIG, the Brazilian airline, distributes on board a toothbrush described in U.S. Pat. No. 4,408,920 (Walther et al.). Bristles and part of the handle reportedly are injection molded together. Materials of construction are enumerated in the patent as being polyethylene, nylon, polyester or polypropylene, with the latter being preferred. Disposable travel brushes represent significant advances in providing low cost hygiene utensils to the general public at an affordable price. Nonetheless, further technical advances are necessary to improve the functional and ergonomic aspects of these products.

An even lower cost low density polyethylene toothbrush is reported in Brazilian Patent 6700603 developed by the University of Sao Paulo, and widely distributed in that country among school age children. Although inexpensively manufacturable, the bristles have a relatively short lifetime, especially when continuously used in a highly vigorous manner against teeth. Deformation and breakage of individual bristles is a significant problem.

A somewhat more sophisticated approach is reported in U.S. Pat. No. 3,302,230 (Poppelmann) which describes a unitarily molded toothbrush fashioned from polyethylene of Melt Index ranging between 1.5 to 5 g/10 min. Improved massage of the gums and better retention of dentifrice is achieved through use of bristles with special polygonal cross-sections. Unfortunately, this patent, like the others does not address the issue of bristle breakage and deformation. Handle ergonomics are also sub-optimal.

Accordingly, it is an object of the present invention to provide a relatively low cost toothbrush manufacturable in a single step and of a unitary construction.

Another object of the present invention is to provide a relatively low cost toothbrush with bristles less prone to breakage or deformation.

Yet another object of the present invention is to provide a relatively low cost toothbrush with bristles that are gentle to the gum yet effective in reaching food debris even in difficultly accessible crevices between teeth.

Still another object of the present invention is to provide a relatively low cost toothbrush with a sufficiently flexible neck to allow bending of the bristle head relative to the handle thereby being ergonomically adjustable to a user's hand pressure.

These and other objects of the present invention will become more readily evident through the following summary and detailed discussion.

SUMMARY OF THE INVENTION

A unitarily molded toothbrush is provided including:

a head with bristles integrally formed with the head, the bristles being anchored to a top surface of the head and each having a polygonal cross-section defined by at least three faces, at least one of the faces gradually transitioning outward as a slope in an area near the head top surface to minimize breakage and deformation;

a neck with first and second ends, the first end connected to the head; and a handle with front and rear ends, the front end connected to the second end of the neck, wherein the head, neck and handle are all formed of an identical plastic material.

Among different polygonal cross-sections, the most preferred is a triangular one.

Most effective for the present invention is the use of a polyolefin as the plastic material. Preferably the polyolefin is a low density polyethylene. This polymer is optimal because of its ready moldability, provision of a relatively rigid handle and yet allowing bristles to be sufficiently flexible to minimize any harsh interaction with the gums.

While having one of the faces provided with a slope at its base minimizes breakage and deformation, it is advantageous to have at least two of the faces gradually transitioning outward in a slope. The slope may be gently curving. However, it is particularly effective that the slopes be straight.

A further refinement of the present invention is to have two of the bristle faces with slopes which are different from one another. Generally the slopes may be set at angles between 5 and 70°. When two of the faces have different slopes from one another, a first of these slopes may have a set of angles between 5 and 50° while the second of these slopes may have a set of angles between 55 and 80°. Most preferred is where the first slope is between 30 and 50° while the second slope is between 55 and 65°. Differences between first and second slopes may advantageously range from 5 to 40°.

Least breakage of bristles occurs where attachment to the head surface along one bristle face is sloped at approximately 45° and along another bristle face is sloped at approximately 60°. Although not wishing to be bound by any theory, it is believed that during injection a non-angled base or one having identical slope angles for a particular bristle will result in a cold flow. In other words, injected resin will become chilled before it traverses the relatively thin mold channel to reach deeper into an area forming the bristle point. Cold flow is considerably minimized by having differently angled slopes along an entrance of a bristle mold channel.

Tips of the bristles may either be pointed or rounded. Gentleness against gums and teeth is improved by rounding the top ends of the individual bristles.

Conventional molding and plastic injection equipment may be utilized for manufacture of toothbrushes according to the present invention. Formation of the bristles occurs within a die mold plate wherein cavities are provided with the bristle design outline. The cavities will include angled or radiused mold sections near areas where the bristle design attaches to a surface of the head.

Advantageously the cavities may be honed, especially vapor honed. Not only is mold release improved but the honing imparts a texturized effect to the resultant bristle. Better cleaning and retention of dentifrice results from the texturization.

BRIEF DESCRIPTION OF THE DRAWING

The above features, advantages and objectives of the present invention will more fully be appreciated through the following detailed discussion, reference being made to the drawing in which:

FIG. 1 is a bottom perspective view of a toothbrush according to the present invention;

FIG. 2 is a top perspective view of the toothbrush according to FIG. 1;

FIG. 3 is a cross-sectional view of a bristle with radiused gently rounded attachment to a surface of the brushhead;

FIG. 4 is a front elevational view of a second embodiment of the bristle showing its attachment to a surface of the brushhead with two differently sloped transitions near the base of two faces of the bristle;

FIG. 5 is a rear elevational view of the bristle shown in FIG. 4;

FIG. 6 is a cross-sectional view of the second embodiment as shown in FIG. 4;

FIG. 7 is a cross-sectional view taken along line 7—7 of FIG. 6.

DETAILED DESCRIPTION OF THE INVENTION

Figure 8:
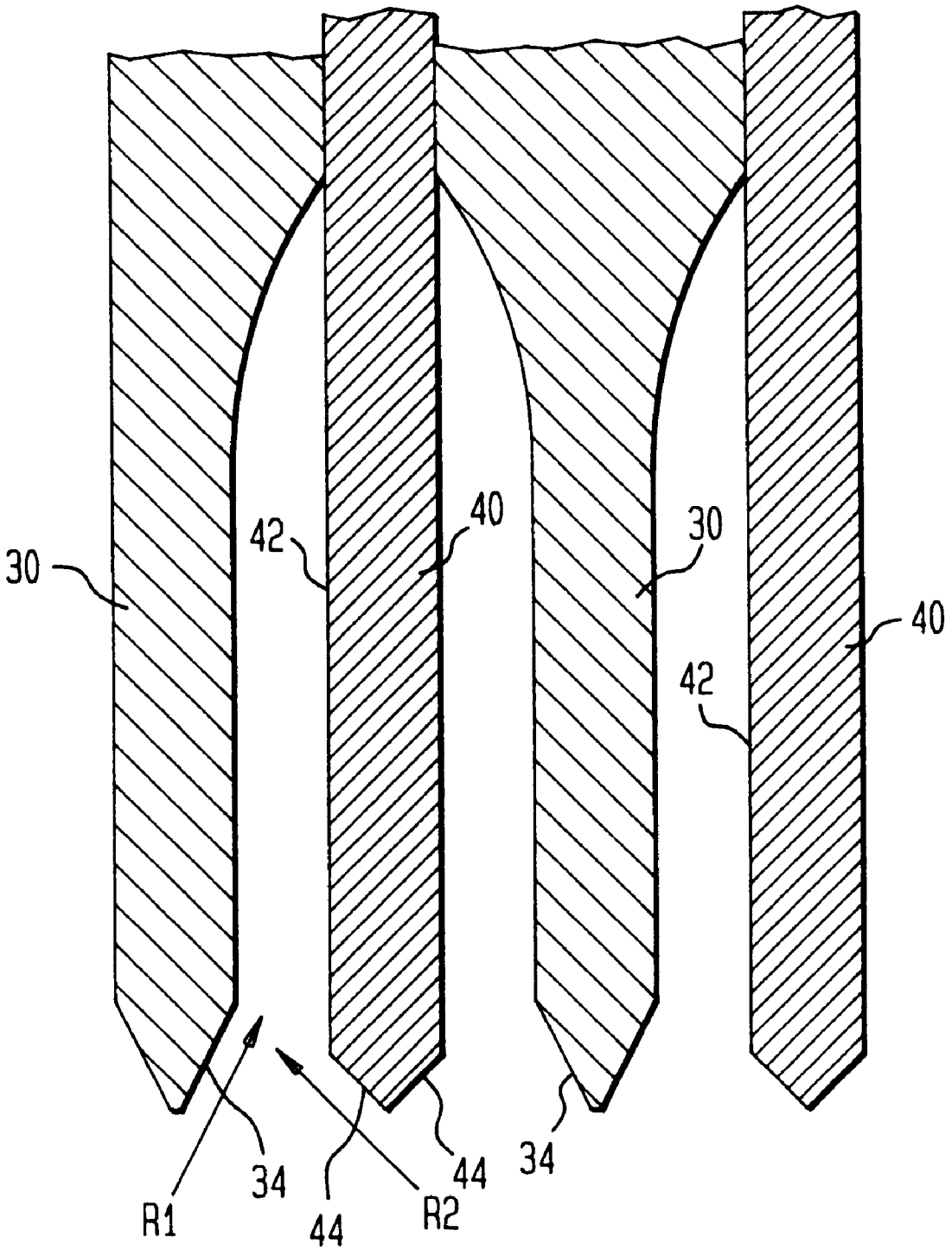
FIG. 8 is a cross-sectional partial view of the bristle forming die mold plate.

Now it has been found that bristle deformation and breakage can be minimized in a unitarily molded toothbrush by providing a gradually transitioning slope to polygonal cross-sectioned bristles in an area near a surface of the brushhead.

A preferred embodiment of the present invention is illustrated in FIG. 1. The toothbrush includes a head 2 having bristles 3, a neck 5 with first and second ends 6, 8 and a handle 10 with front and rear ends 12, 14. An ornamental faux pad 13 and gripping ridges 15 are shown in the preferred embodiment of FIG. 2, but need not be present for purposes of this invention.

FIG. 1 illustrates a recess 16 in an undersurface 18 of the toothbrush. The recess 16 along its perimeter is defined by a recess opening 20.

FIG. 3 illustrates a cross-section along a longitudinal direction of a single bristle 103. This bristle is triangular in horizontal cross-section having a flat rear face 122 and flanking side faces 124,126. Near a base of the bristle in an area attached to the brushhead surface 128, is a respective web 130,132 each with a radiused slope 134,136.

FIG. 4 illustrates a second more preferred embodiment of the bristle attachment to the brushhead. Bristle 203 is also triangular in horizontal cross-section as seen in FIG. 7. The polygonal shape includes a rear face 222 and flanking side faces 224, 226. A web 230 near a base of the bristle attached to the brushhead surface 228 gradually transitions outward forming faces 234, 235.

FIG. 5 illustrates the rear face 222 with a web 232 forming attachment to brushhead surface 228 along a different angled face 236.

FIG. 6 illustrates the slope of face 234 as a 45° angle and the slope of face 236 as a 60° angle.

FIG. 8 illustrates a portion of the die mold plate wherein the bristles of the present invention are formed. A mold wall 30 forming faces 224 and 226 of the bristle has an entry surface 34. A center mold wall 40 has surface 42 which forms face 222. Near the resin entry point of the mold, surface 42 has a slanted surface 44 which allows formation of face 236 of the molded bristle 203. Resin can flow angularly along path R1 and R2 past the gate surfaces 34 and 44. Cold flow is minimized in this arrangement where the surfaces are acutely angled against one another.

While this invention have been shown and described in connection with particular preferred embodiments, various changes and modifications are readily available to those skilled in the art without departing from the basic scope and purview of this invention.

What is claimed is:

1. A unitarily molded toothbrush comprising:

a head with bristles integrally formed with the head, the bristles being anchored to a top surface of the head and each having a polygonal cross-section defined by at least three faces, two of the faces gradually transitioning outward forming respective first and second slopes in an area near the head top surface to minimize breakage and deformation, the first of the slopes being differently angled than the second of the slopes;

a neck with first and second ends, the first end connected to the head; and a handle with front and rear ends, the front end connected to the second end of the neck, wherein the head, neck and handle are all formed of an identical plastic material.

2. The toothbrush according to claim 1 wherein at least one of the slopes is a straight slope.

3. The toothbrush according to claim 1 wherein at least one of the slopes is a curved radiused slope.

4. The toothbrush according to claim 1 wherein the polygonal cross-section is triangular.

5. The toothbrush according to claim 1 wherein the first and second slopes are set at angles between 5 and 70°.

6. The toothbrush according to claim 1 wherein the first slope is set at an angle between 5 and 50° and the second slope is set at an angle between 55 and 80°.

7. The toothbrush according to claim 6 wherein the first slope is set at an angle between 30 and 50 ° and the second slope is set at an angle between 55 and 65°.

8. The toothbrush according to claim 1 wherein the difference in slope between first and second slopes range from 5 to 40°.

* * * * *

UNITED STATES PATENT AND TRADEMARK OFFICE

CERTIFICATE OF CORRECTION

PATENT NO. : 5,926,900

DATED : July 27, 1999

INVENTOR(S) : Bennett

It is certified that error appears in the above-indentified patent and that said Letters Patent is hereby corrected as shown below:

On the title page, item [73], change Assignee from "Chesebrough-Pond's USA Co.,"

to read -- Chesebrough-Pond's USA Co., Division of Conopco, Inc. --

Signed and Sealed this

Twenty-eighth Day of March, 2000

*Attest:*

Q. TODD DICKINSON

*Attesting Officer*

*Commissioner of Patents and Trademarks*